US012351931B2

(12) United States Patent
Hiwatashi et al.

(10) Patent No.: US 12,351,931 B2
(45) Date of Patent: Jul. 8, 2025

(54) PLATING APPARATUS

(71) Applicant: EBARA CORPORATION, Tokyo (JP)

(72) Inventors: Ryosuke Hiwatashi, Tokyo (JP); Masashi Shimoyama, Tokyo (JP); Yasuyuki Masuda, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 450 days.

(21) Appl. No.: 17/761,550

(22) PCT Filed: Dec. 28, 2020

(86) PCT No.: PCT/JP2020/049154
§ 371 (c)(1),
(2) Date: Mar. 17, 2022

(87) PCT Pub. No.: WO2022/144985
PCT Pub. Date: Jul. 7, 2022

(65) Prior Publication Data

US 2023/0167574 A1 Jun. 1, 2023

(51) Int. Cl.
*C25D 21/04* (2006.01)
*C25D 17/00* (2006.01)
*C25D 21/10* (2006.01)

(52) U.S. Cl.
CPC ..... *C25D 21/04* (2013.01); *C25D 17/002* (2013.01); *C25D 17/008* (2013.01); *C25D 21/10* (2013.01)

(58) Field of Classification Search
None
See application file for complete search history.

(56) References Cited

U.S. PATENT DOCUMENTS 4,687,554 A * 8/1987 Shyu ..... C25D 5/08 205/148
2007/0246350 A1 10/2007 Togashi
2010/0147679 A1* 6/2010 Feng ..... C25D 17/001 204/275.1

(Continued)

FOREIGN PATENT DOCUMENTS

JP 2002-004099 A 1/2002
JP 2005-068561 A 3/2005

(Continued)

*Primary Examiner* — Louis J Rufo
(74) *Attorney, Agent, or Firm* — BakerHostetler

(57) ABSTRACT

A technique capable of preventing bubbles from being accumulated on a lower surface of an electric field shield plate is provided. A plating apparatus includes: a plating tank in which a plating solution is retained, and an anode is arranged: a substrate holder that is arranged above the anode, and holds a substrate serving as a cathode such that a surface to be plated of the substrate faces the anode; a diaphragm that partitions an inside of the plating tank into an anode region where the anode is arranged, and a cathode region where the substrate is arranged; and a supporting member that is in contact with a lower surface of the diaphragm and supports the diaphragm, and includes a plurality of beam components extending over regions between the anode and the substrate along the lower surface of the diaphragm, the beam components including bubble guide paths for guiding bubbles from the regions between the anode and the substrate to an outside.

14 Claims, 8 Drawing Sheets

(56) References Cited

U.S. PATENT DOCUMENTS

| | | | | |
|---|---|---|---|---|
| 2010/0307913 | A1* | 12/2010 | Ma | C25D 17/00 204/266 |
| 2011/0073469 | A1 | 3/2011 | Ma et al. | |
| 2016/0348263 | A1 | 12/2016 | Woodruff et al. | |
| 2019/0055665 | A1* | 2/2019 | Banik, II | C25D 17/005 |
| 2019/0390360 | A1 | 12/2019 | Shimomura et al. | |

FOREIGN PATENT DOCUMENTS

| | | | |
|---|---|---|---|
| JP | 2007-169773 | A | 7/2007 |
| JP | 2007-291419 | A | 11/2007 |
| JP | 2008-019496 | A | 1/2008 |
| JP | 2009-179821 | A | 8/2009 |
| JP | 2019-218618 | A | 12/2019 |
| KR | 2010-0096127 | A | 9/2010 |
| TW | 201704556 | A | 2/2017 |
| TW | 201920778 | A | 6/2019 |

* cited by examiner

1000

PLATING APPARATUS

TECHNICAL FIELD

The present invention relates to a plating apparatus.

BACKGROUND ART

Conventionally, as a plating apparatus of performing a plating process on a substrate, a cup-type plating apparatus has been known (e.g., see PTL 1). Such a plating apparatus includes: a plating tank where an anode is arranged; and a substrate holder that is arranged above the anode, and holds a substrate serving as a cathode such that a surface to be plated of the substrate faces the anode.

Conventionally, a soluble anode that is dissolved in a plating solution or an insoluble anode that is not dissolved in the plating solution is used as the anode. In a case of performing the plating process using the insoluble anode, oxygen is generated by the reaction between the anode and the plating solution. In some cases, the plating solution contains additive for increasing or reducing the film forming speed of the plating film, or improving the film quality of the plating film. The additive is decomposed by reaction with the oxygen. It has also been known that in a case of using, for example, phosphorus-containing copper as the soluble anode, additive, in particular, accelerator is altered by reaction with monovalent copper generated from the anode not during electrolysis. In order to prevent this, the additive may be added to the plating solution as needed so as to maintain the concentration of the additive in the plating solution at a certain value or higher. However, since the additive is expensive, it is desired to reduce the decomposition of the additive as much as possible.

Accordingly, it is proposed that a space (anode region) where the anode is arranged and a space (cathode region) where the substrate and the cathode is arranged in the plating solution tank are partitioned by a diaphragm to prevent the additive in the plating solution from reaching the anode and reduce the decomposition of the additive (e.g., see PTL 2).

CITATION LIST

Patent Literature

PTL 1: Japanese Patent Laid-Open No. 2008-19496
PTL 2: Japanese Patent Laid-Open No. 2019-218618

SUMMARY OF INVENTION

Technical Problem

It can be considered to apply the technique as exemplified in PTL 2 to the conventional cup-type plating apparatus as exemplified in PTL 1 and arrange a diaphragm at a portion in the plating tank between the anode and the substrate. However, in the case of such a plating apparatus, bubbles in the plating solution are possibly accumulated on the lower surface of the diaphragm. If the bubbles are accumulated on the lower surface of the diaphragm, the current between the substrate and the anode are reduced by the bubbles, and the plating quality of the substrate is possibly degraded.

The present invention has been made in view of the above description, and has an object to provide a technique capable of preventing bubbles from accumulated on the lower surface of the diaphragm.

Solution to Problem

According to one embodiment, a plating apparatus is proposed. The plating apparatus includes: a plating tank in which a plating solution is retained, and an anode is arranged: a substrate holder that is arranged above the anode, and holds a substrate serving as a cathode such that a surface to be plated of the substrate faces the anode; a diaphragm that partitions an inside of the plating tank into an anode region where the anode is arranged, and a cathode region where the substrate is arranged; and a supporting member that is in contact with a lower surface of the diaphragm and supports the diaphragm, and includes a plurality of beam components extending over regions between the anode and the substrate along the lower surface of the diaphragm, the beam components including bubble guide paths for guiding bubbles from the regions between the anode and the substrate to an outside. This plating apparatus can prevent bubbles from being accumulated on the lower surface of the diaphragm.

DESCRIPTION OF EMBODIMENTS

Hereinafter, embodiments of the present invention are described with reference to the drawings. Note that in the following embodiments and modification example of the embodiments, the same or corresponding components are assigned the same symbols, and the description is appropriately omitted in some cases. The drawings are schematically illustrated for facilitating understanding of the characteristics of the embodiments. The dimensions, ratios and the like of the individual configuration elements are not necessarily identical to those in actual cases.

<Overall Configuration of Plating Apparatus>

Figure 1:
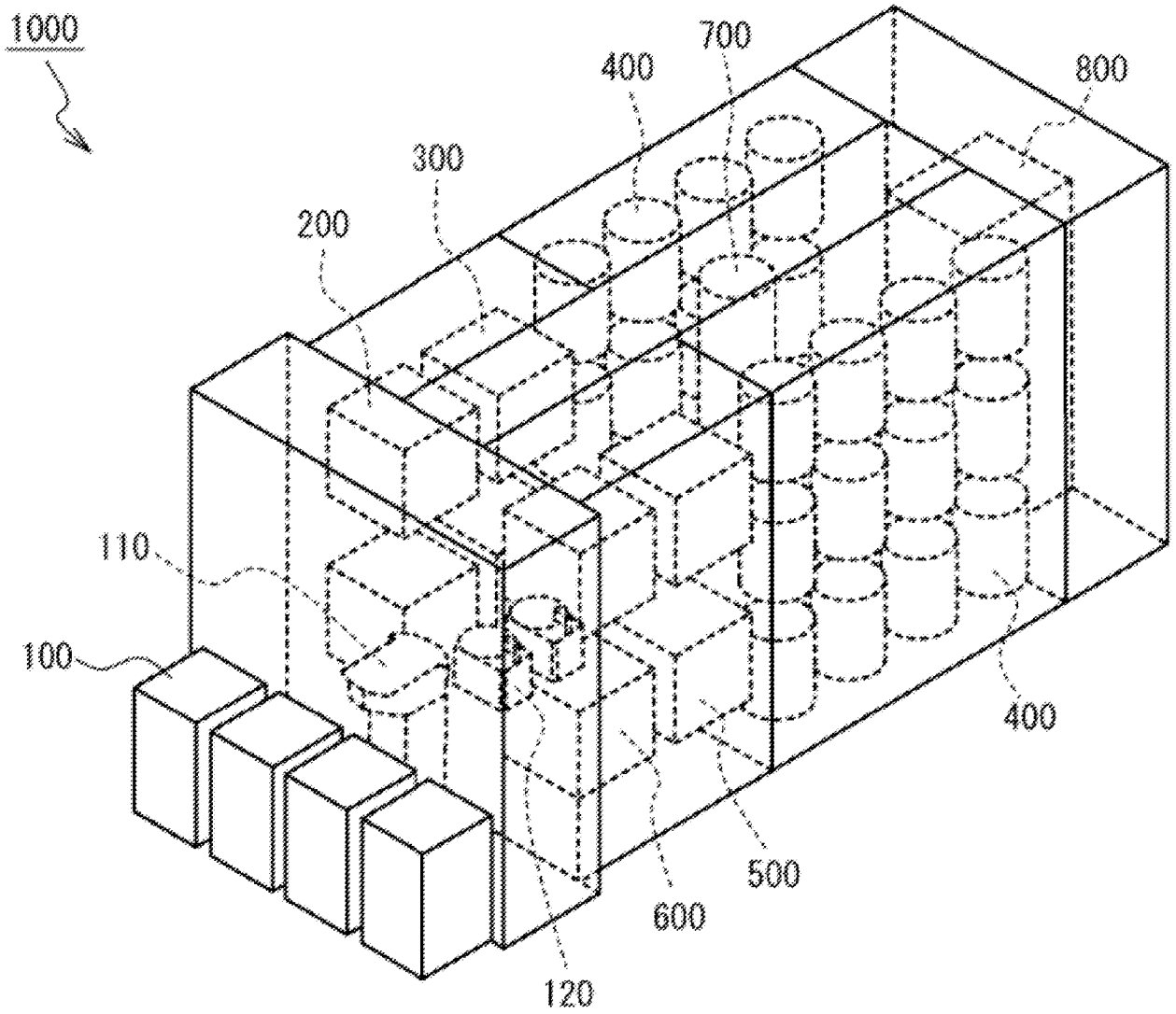
FIG. 1 is a perspective view illustrating the overall configuration of a plating apparatus of an embodiment.

FIG. 1 is a perspective view illustrating the overall configuration of the plating apparatus of this embodiment.

Figure 2:
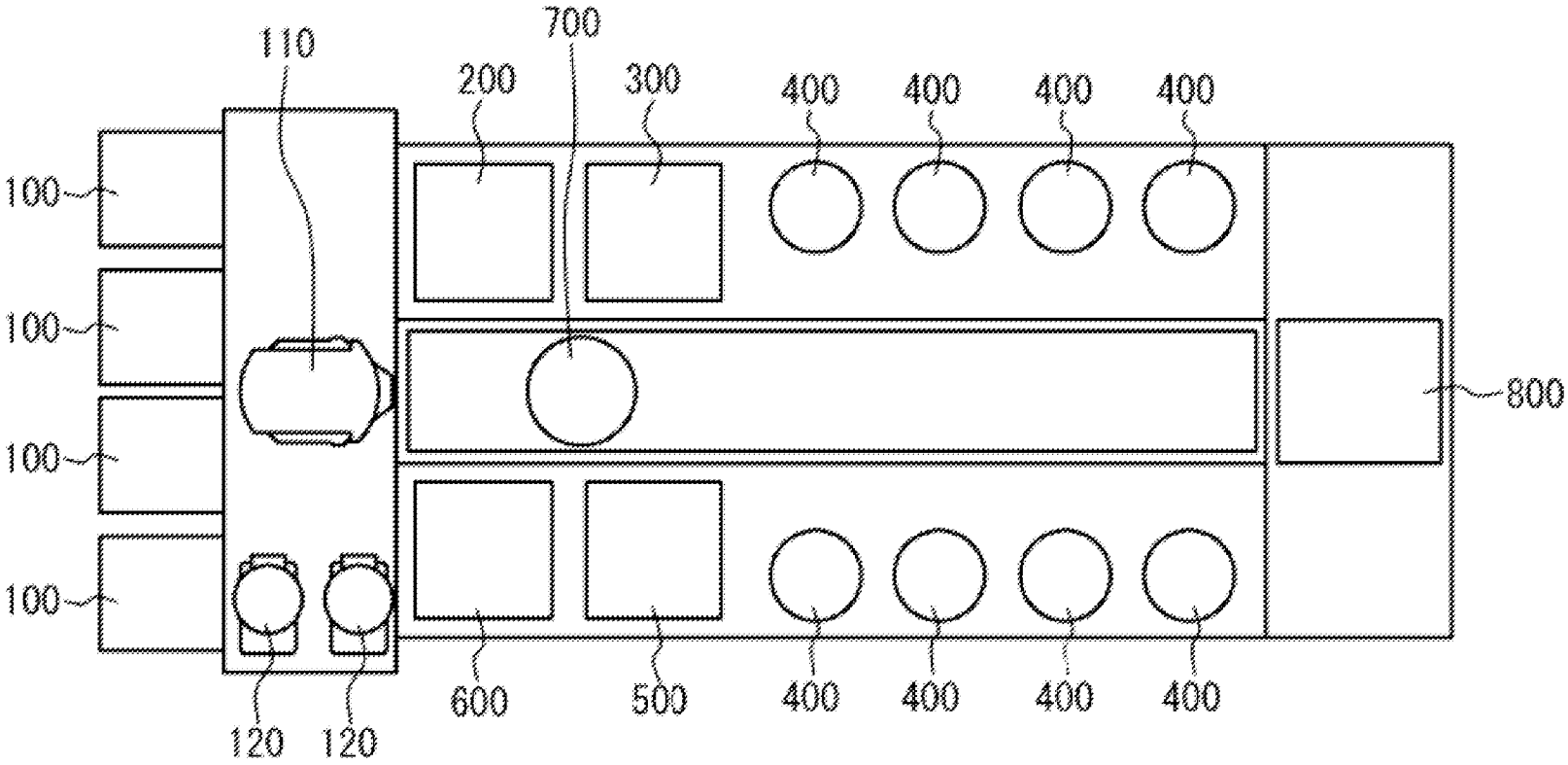
FIG. 2 is a plan view illustrating the overall configuration of the plating apparatus of the embodiment.

FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP. (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transfer the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described with reference to FIGS. 1 and 2 is only one example. The configuration of the plating apparatus 1000 is not limited to the configuration in FIGS. 1 and 2.

<Plating Module>

Subsequently, the plating modules 400 will be described. The plurality of plating modules 400 that the plating apparatus 1000 according to this embodiment includes have similar configurations. Accordingly, one plating modules 400 will be described.

First Embodiment

Figure 3:
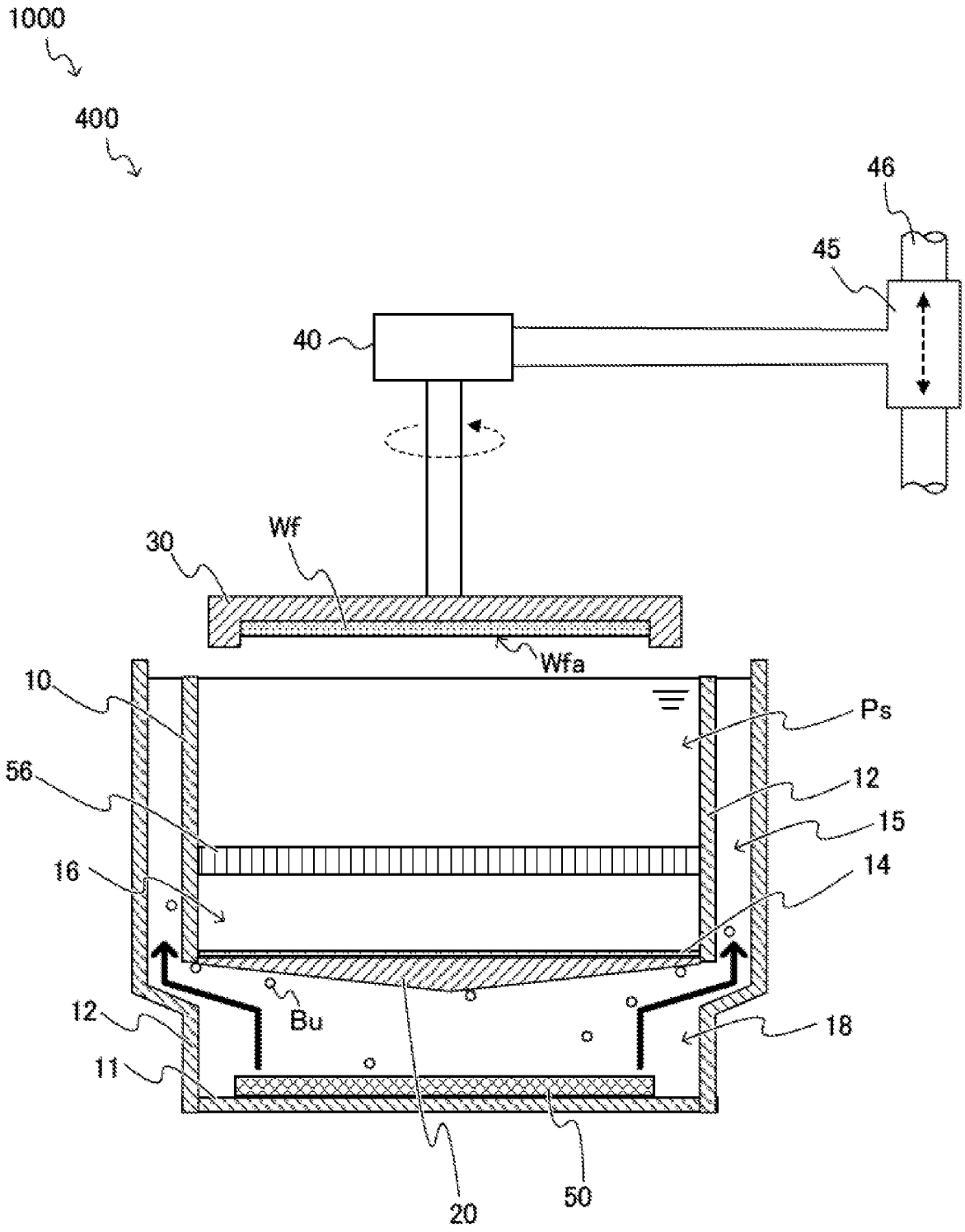
FIG. 3 is a schematic sectional view illustrating the configuration of a plating module of a first embodiment in the plating apparatus.

FIG. 3 is a schematic sectional view illustrating the configuration of a plating module 400 of a first embodiment in the plating apparatus 1000. The plating apparatus 1000 according to this embodiment is a cup-type plating apparatus. Each plating module 400 of the plating apparatus 1000 includes a plating tank 10, a substrate holder 30, a rotation mechanism 40, a lifting and lowering mechanism 45, and a resistor 56.

The plating tank 10 according to this embodiment is configured as a container that has a bottom, and an opening at the upper end. Specifically, the plating tank 10 includes a bottom 11, and a peripheral portion 12 (in other words, a peripheral side wall) extending upward from the periphery of the bottom 11. The upper part of the peripheral portion 12 is open. Note that the shape of the peripheral portion 12 of the plating tank 10 is not specifically limited. The peripheral portion 12 according to this embodiment has a cylindrical shape, for example. A plating solution Ps is retained in the plating tank 10. Note that the plating module 400 may be further provided with an overflow tank that is provided so as to temporarily retain the plating solution Ps having exceeded over the top end of the peripheral portion 12 of the plating tank 10 (i.e., the plating solution Ps overflown from the plating tank 10).

The plating solution Ps may be a solution that contains metal element ions that are to constitute a plating film. A specific example is not particularly limited. In this embodiment, a copper plating process is used as an example of the plating process, and a copper sulfate solution is used as an example of the plating solution Ps.

An anode 50 is arranged in the plating tank 10. Specifically, the anode 50 according to this embodiment is arranged on the bottom 11 of the plating tank 10. The anode 50 according to this embodiment is arranged so as to extend in the horizontal direction.

A specific type of the anode 50 is not particularly limited, and an insoluble anode or a soluble anode may be adopted. In this embodiment, an insoluble anode is used as an example of the anode 50. A specific type of the insoluble anode is not particularly limited, and platinum, iridium oxide or the like may be adopted.

The substrate holder 30 holds a substrate Wf as a cathode such that the surface Wfa to be plated of the substrate Wf can face the anode 50. In other words, the substrate holder 30 holds the substrate Wf such that the surface Wfa to be plated of the substrate Wf is oriented downward. The rotation mechanism 40 is connected to the substrate holder 30. The rotation mechanism 40 is a mechanism for rotating the substrate holder 30. A lifting and lowering mechanism 45 is connected to the rotation mechanism 40. The lifting and lowering mechanism 45 is supported by a supporting column 46 that extends in the vertical direction. The lifting and lowering mechanism 45 is a mechanism for lifting and lowering the substrate holder 30 and the rotation mechanism 40 in the vertical direction. Note that the substrate Wf and the anode 50 are electrically connected to an energization device (not illustrated). The energization device is a device for causing current to flow between the substrate Wf and the anode 50 during execution of a plating process.

The resistor 56 is provided between the anode 50 and the substrate Wf and is arranged so as to be in parallel with the anode 50 and the substrate Wf. In this embodiment, the resistor 56 is connected to the entire peripheral portion 12 of the plating tank 10 in the circumferential direction, and has a circular disk shape in a plan view. The resistor 56 is made of a porous member having a plurality of holes. Specifically, the plurality of holes are formed to cause a region above the resistor 56 and a region below the resistor 56 to communicate with each other. Note that the specific material of the resistor 56 is not particularly limited, and in this embodiment, for example, a resin, such as polyetherecherketone, is adopted. In this embodiment, although not limited, the resistor 56 is provided in a cathode region 16 described later. Note that the plating module 400 may include no resistor 56.

When the plating process is executed, first, the rotation mechanism 40 rotates the substrate holder 30, and the lifting and lowering mechanism 45 moves the substrate holder 30 downward, and soaks the substrate Wf in the plating solution Ps in the plating tank 10. Next, current flows between the anode 50 and the substrate Wf owing to the energization device. Accordingly, a plating film is formed on the surface Wfa to be plated of the substrate Wf The plating module 400 includes a diaphragm 14 that partitions the inside of the plating tank 10 in the vertical direction. The inside of the plating tank 10 is partitioned by the diaphragm 14 into a cathode region 16 and an anode region 18. The diaphragm 14 is, for example, an ion-exchange membrane, such as a cation-exchange membrane, or a neutral diaphragm. The diaphragm 14 can allow cations to pass from the anode side to the cathode side upon the plating process without allowing the additive in the plating solution Ps to pass. A specific example of the diaphragm 14 may be YUMICRON® manufactured by Yuasa Membrane Systems Co., Ltd The diaphragm 14 is arranged in the plating tank 10 by being supported by the supporting member 20. The supporting member 20 is fixed to the peripheral portion (peripheral side wall) 12 of the plating tank 10, for example. Note that the supporting member 20 may be fixed to the peripheral portion 12 of the plating tank 10 with fasteners, such as screws, or may be configured as a member integral with the peripheral portion 12 of the plating tank 10. Note that the supporting member 20 can support the diaphragm 14 by any of various methods. For example, the supporting member 20 may support the diaphragm 14 by causing the diaphragm 14 to intervene in the supporting member 20 in a manner of clamping in the vertical direction. For example, the diaphragm 14 may be fixed to the supporting member 20 using an adhesive, or fasteners, such as screws.

Figure 4:
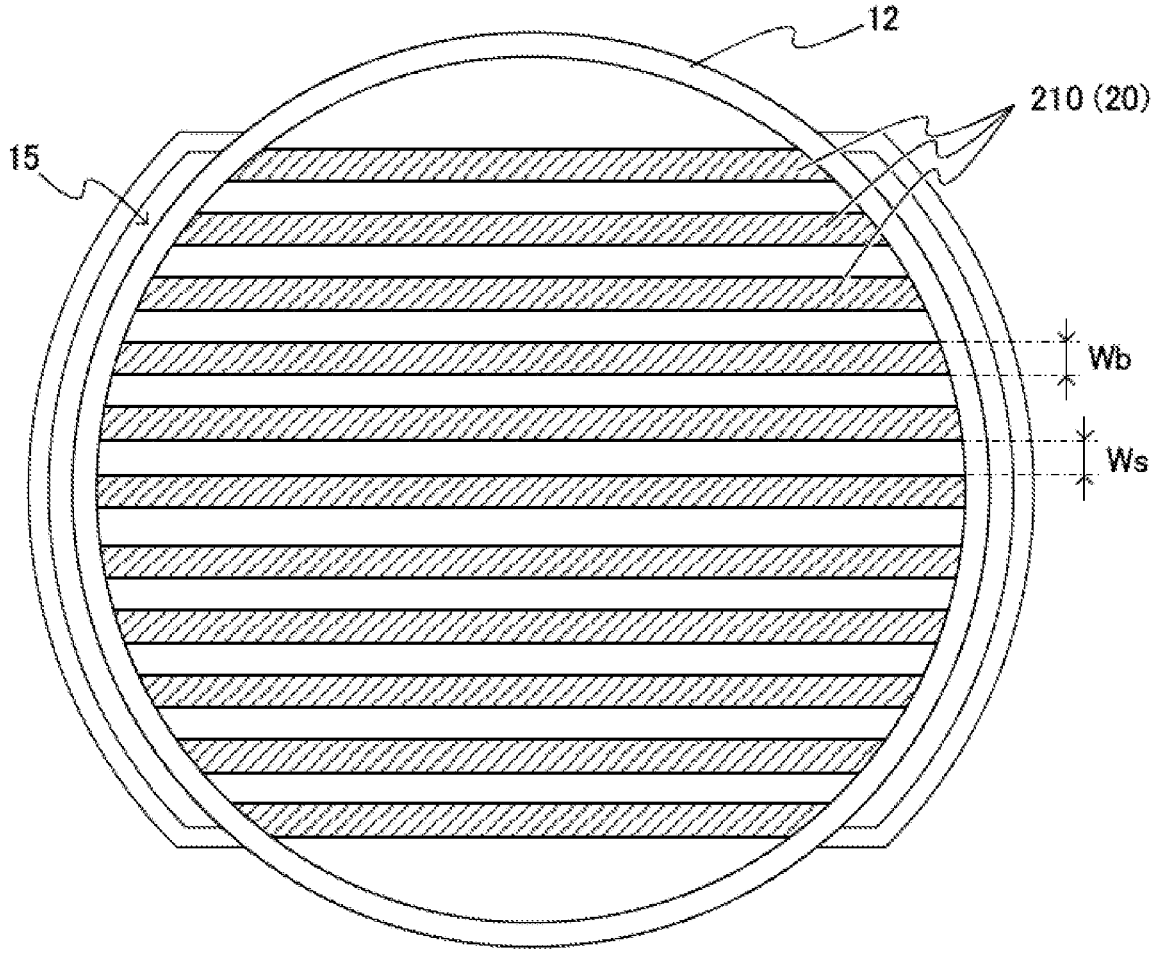
FIG. 4 is a schematic view illustrating a plating tank and a supporting member of the first embodiment viewed from above in the vertical direction.

FIG. 4 is a schematic view illustrating the plating tank 10 and the supporting member 20 of the first embodiment viewed from above in the vertical direction. Note that in FIG. 4, for the sake of easy understanding, the supporting member 20 (a plurality of beam components 210) is hatched. In FIG. 4, the beam components 210 are illustrated by indicating projected shapes in the vertical direction, and are indicated to include upper surface parts 222 and side surface parts 224, described later. The supporting member 20 includes the plurality of beam components 210 extending over regions between the anode 50 and the substrate Wf along the lower surface of the diaphragm 14. Hereinafter, in a plan view, regions between the anode 50 and the substrate Wf where the supporting member 20 (beam components 210) is present are also called "shield regions", and regions where the supporting member 20 (beam components 210) is absent are also called "non-shield regions". In the example illustrated in FIG. 4, the beam components 210 each linearly extend from one end of the peripheral portion 12 of the plating tank 10 to the other end, and are provided in parallel with each other. In the example illustrated in FIG. 4, the beam components 210 each have the same width (the length in the vertical direction in FIG. 4) Wb. Furthermore, the beam components 210 are each arranged at regular intervals. In other words, the gaps between the beam components 210, that is, the widths of the respective non-shield regions (the lengths in the vertical direction) Ws are the same.

However, without any limitation to such an example, among the beam components 210, beam components 210 (first beam components) nearer to the center of the plating tank 10 (or the substrate Wf) may have a first width Wb, and beam components 210 (second beam components) farther from the center of the plating tank 10 may have a second width Wb that is larger or smaller than the first width Wb. For example, among the beam components 210, the nearer to the center of the plating tank 10, the smaller the widths Wb of the beam components 210 may be. The farther from the center of the plating tank 10, the larger the widths Wb of the beam components 210 may be.

Alternatively, among the gaps between the beam components 210, i.e., the non-shield regions, regions (first non-shield regions) nearer to the center of the plating tank 10 (or the substrate Wf) may have a first width Ws. and regions (second non-shield regions) farther from the center of the plating tank 10 may have a second width Ws that is larger or smaller than the first width Ws. For example, among the non-shield regions, the nearer to the center of the plating tank 10 the region is, the larger the widths Ws may be, and the farther from the center of the plating tank 10 the beam component is, the smaller the widths Ws may be.

The beam components 210 are not limited to what linearly extend, and may be, for example, have wave shapes or curved shapes. The beam components 210 are not necessarily provided in parallel with each other. For example, these components may radially extend and be connected to each other.

Preferably, area (i.e., shield regions) where the beam components 210 are resent between the anode 50 and the substrate Wf may be 40 percent or less than the surface Wfa to be plated of the substrate Wf. This is because it is conceivable that with the shield regions being 40 percent or less than the surface Wfa to be plated of the substrate Wf, the adverse effects of reduction in current between the anode 50 and the substrate Wf due to the supporting member 20 are small. More preferably, the beam components 210 have the shield regions that are 30 percent or less of the surface Wfa to be plated of the substrate Wf; further preferably, the regions are 20 percent or less.

In this embodiment, the beam components 210 are not provided in end regions (an upper end region and a lower end region in FIG. 4) far from the center of the substrate Wf. Note that without any limitation to such an example, the beam components 210 may be provided also in the end regions.

Incidentally, the plating solution Ps, particularly at the anode region 18, sometimes contains bubbles Bu. Specifically, the bubbles Bu may be bubbles Bu contained in the plating solution Ps when the plating solution Ps is supplied to the plating tank 10, or bubbles Bu generated from the anode 50 during execution of the plating process. If the bubbles Bu are accumulated on the lower surface of the diaphragm 14, the current between the substrate Wf and the anode 50 is reduced by the bubbles Bu, and the plating quality of the substrate Wf is possibly degraded. To solve this problem, according to this embodiment, the beam components 210 of the supporting member 20 have bubble guide paths for guiding bubbles from the regions between the anode 50 and the substrate Wf to the outside.

Figure 5:
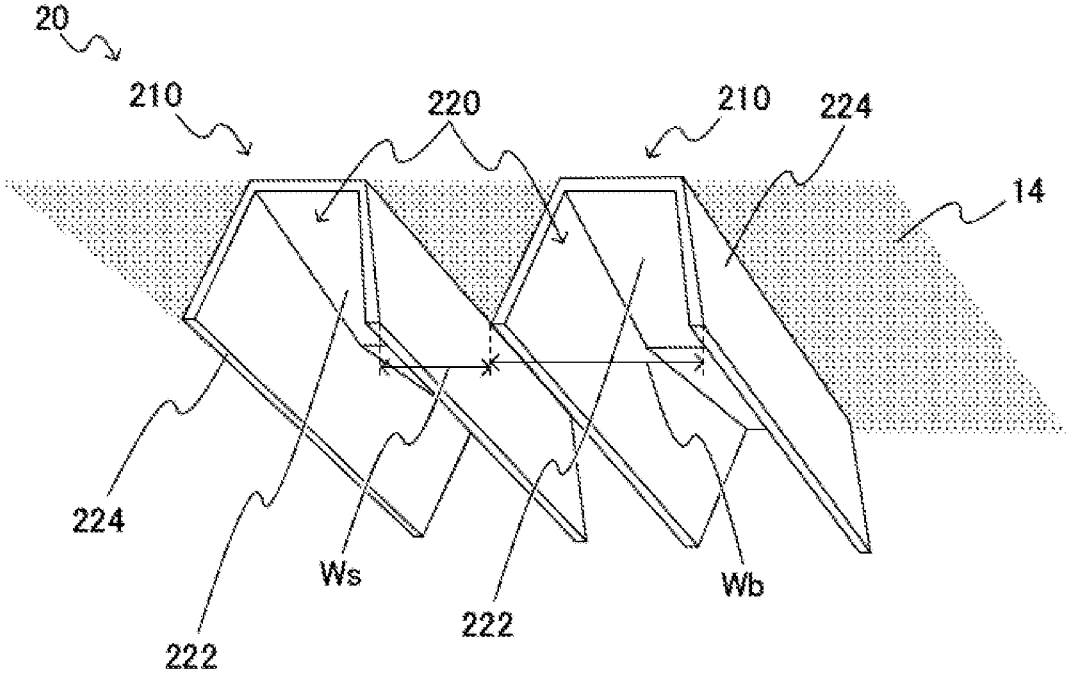
FIG. 5 is a perspective view schematically illustrating beam components of the first embodiment viewed from below.

FIG. 5 is a perspective view schematically illustrating the beam components 210 of the first embodiment viewed from below. Note that for the sake of easy understanding, in FIG. 5, the diaphragm 14 is indicated with hatching. As illustrated in FIG. 5, the beam components 210 in the first embodiment respectively have guide grooves that are open downward, as bubble guide paths 220. That is, each of the beam components 210 includes an upper surface part 222 that is in contact with the diaphragm 14, and side surface parts 224 that extend downward from the opposite ends of the upper surface part 222 in the transverse direction. The bubble guide path 220 is defined by the side surface parts 224 and the upper surface part 222.

In this embodiment, the side surface parts 224 are provided to be inclined from the upper surface part 222 such that the guide groove serving as the bubble guide path 220 flares downward. In other words, the guide grooves serving as the bubble guide paths 220 are formed to have tapered shapes that become narrower as approaching the centers of the beam components 210 in the transverse direction. Accordingly, the bubbles can be suitably collected into the bubble guide paths 220. Without any limitation to such an example, for instance, the side surface parts 224 may be provided along the vertical direction. Note that in the case where the side surface parts 224 of the beam components 210 are inclined outward from the upper surface parts 222 as shown in FIG. 5, the distance between the lower ends of the side surface parts 224 corresponds to the width Wb of the beam component 210, and the distance between the lower ends of the side surface parts 224 of the beam components 210 that are adjacent to each other corresponds to the width Ws of the non-shield region. That is, "shield regions" are regions where the diaphragm 14 is covered with the beam components 210 when being viewed from below, and "non-shield regions" are regions where the diaphragm 14 is not covered with the beam components 210 when being viewed from below.

Figure 6:
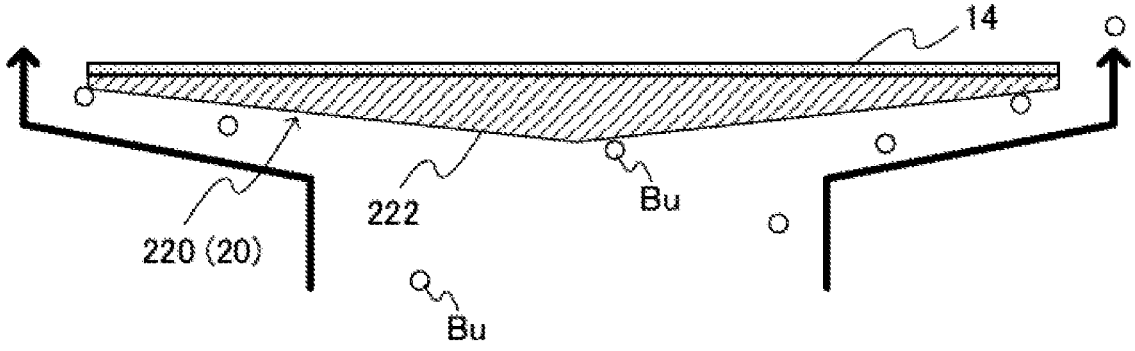
FIG. 6 schematically illustrates a section of the beam component of the first embodiment taken in the longitudinal direction.

FIG. 6 schematically illustrates a section of the beam component 210 of the first embodiment taken in the longitudinal direction. As illustrated in FIGS. 5 and 6, according to this embodiment, the guide grooves as the bubble guide paths 220 include inclined surfaces that protrude more downward as approaching the center of the plating tank 10. That is, particularly illustrated in FIG. 6, the upper surface parts 222 of the beam components 210 are inclined upward as approaching the outside from the center of the plating tank 10. Accordingly, as indicated by open white circles and thick arrows in FIG. 6, the bubbles Bu contained in the bubble guide paths 220 can be guided toward the outside of the plating tank 10. Note that in the example illustrated in FIGS. 5 and 6, the upper surface parts 222 of the beam components 210 are linearly inclined. Without any limitation to such an example, for instance, the parts may be inclined to have curved shapes.

Referring again to FIGS. 3 and 4, the plating module 400 of the first embodiment includes, in the anode region 18, a communication flow path 15 that allows the bubble guide paths 220 of the beam components 210 to communicate with the outside of the plating tank 10. In the example illustrated in FIG. 3, the communication flow path 15 is provided completely through the peripheral portion 12 of the plating tank 10 to the top end of the plating tank 10 along the peripheral surface of the peripheral portion 12.

According to such a configuration, in the plating module 400 in this embodiment, as indicated by the thick arrows in FIG. 3, the bubbles Bu that are present in the anode region 18 can be allowed to be effectively released from between the anode 50 and the substrate Wf to the outside through the supporting member 20 (bubble guide paths 220). Specifically, the bubbles Bu that are present in the anode region 18 are collected into the bubble guide paths 220 of the supporting member 20, are guided into the communication flow path 15, and are discharged from the communication flow path 15 to the outside of the plating tank 10. Accordingly, bubbles Bu can be prevented from being accumulated on the lower surface of the diaphragm 14. Consequently, the plating quality of the substrate Wf can be prevented from being degraded.

Second Embodiment

Figure 7:
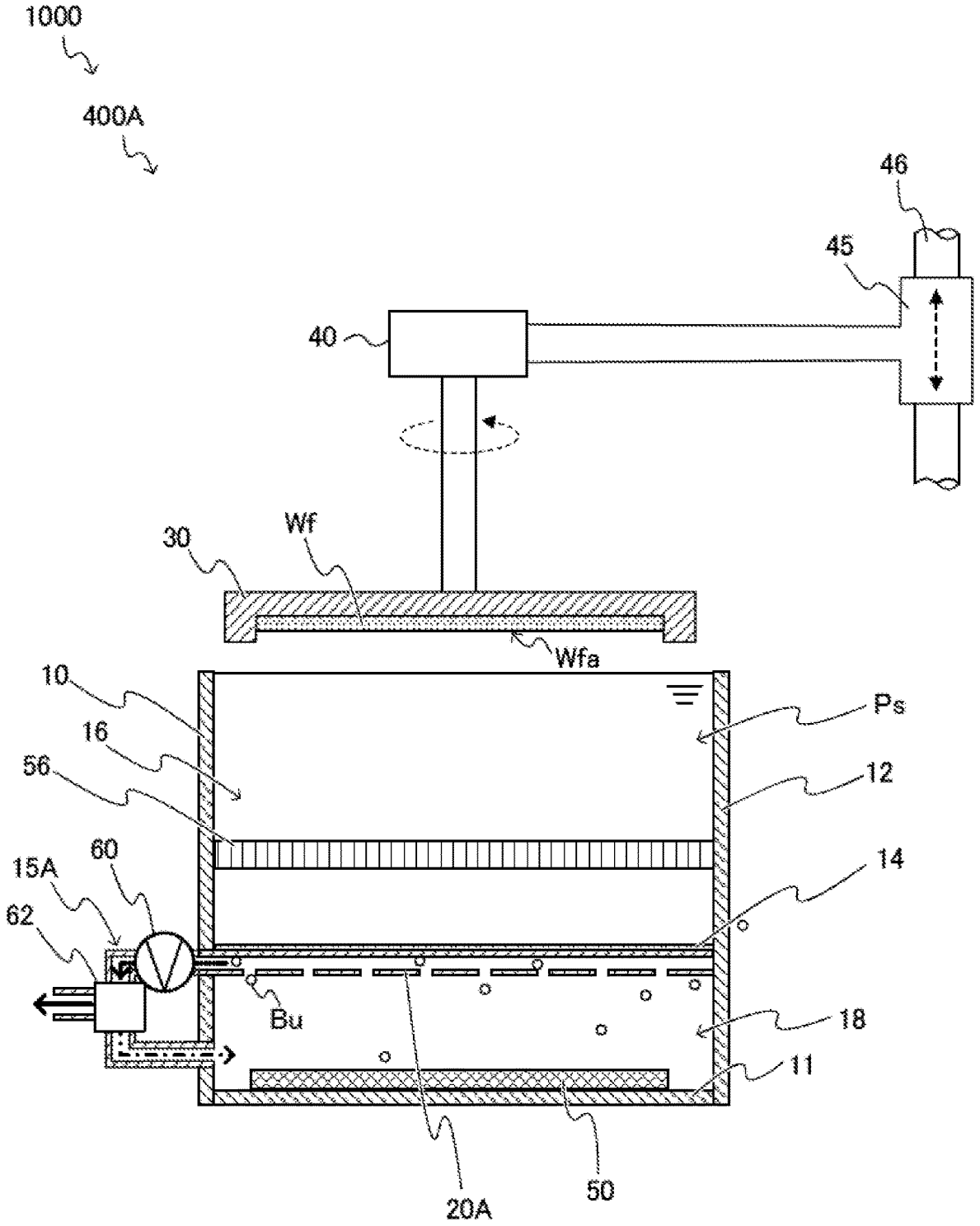
FIG. 7 is a schematic sectional view illustrating the configuration of a plating module 400A of a second embodiment in the plating apparatus.

FIG. 7 is a schematic sectional view illustrating the configuration of a plating module 400A of a second embodiment in the plating apparatus 1000. The plating module 400A of the second embodiment is different from the plating module 400 of the first embodiment in a supporting member 20A that supports the diaphragm 14 and its peripheral components, and is the same as the plating modules 400 of the first embodiment in the other points. In the plating module 400A of the second embodiment, the same components as those of the plating modules 400 of the first embodiment are assigned the same symbols. Redundant description is omitted.

Figure 8:
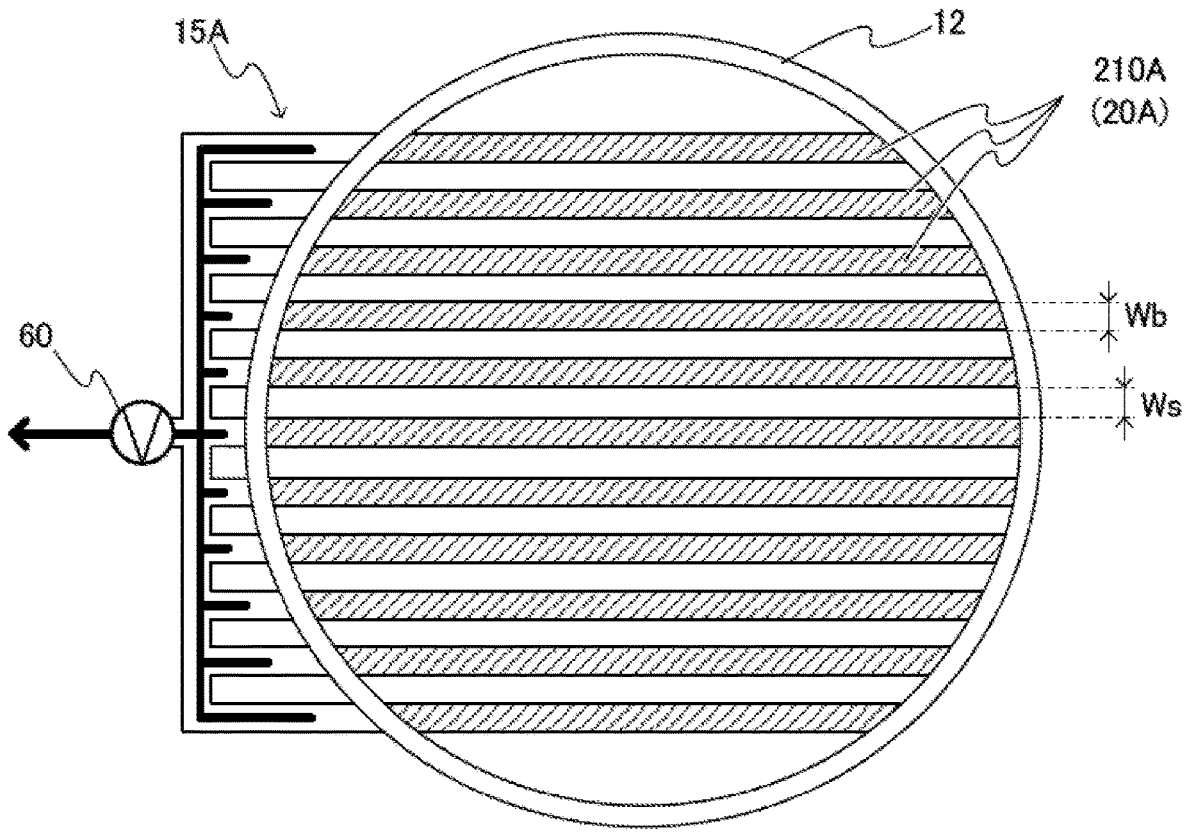
FIG. 8 is a schematic view illustrating a plating tank and a supporting member of the second embodiment viewed from above in the vertical direction.

Also in the second embodiment, the diaphragm 14 is arranged in the plating tank 10 by a supporting member 20A. Similar to the supporting member 20 of the first embodiment, the supporting member 20A is fixed to the peripheral portion 12 of the plating tank 10, for example. FIG. 8 is a schematic view illustrating the plating tank 10 and the supporting member 20A of the second embodiment viewed from above in the vertical direction. Note that in FIG. 8, for the sake of easy understanding, the supporting member 20A (a plurality of beam components 210A) is hatched. In FIG. 8, the beam components 210A have projected shapes in the vertical direction. Similar to the supporting member 20 of the first embodiment, the supporting member 20A includes the plurality of beam components 210A extending over regions between the anode 50 and the substrate Wf along the lower surface of the diaphragm 14. Similar to the description of the beam components 210 in the first embodiment, the beam components 210A in the second embodiment are not limited to the example illustrated in FIG. 8 and the like.

Figure 9:
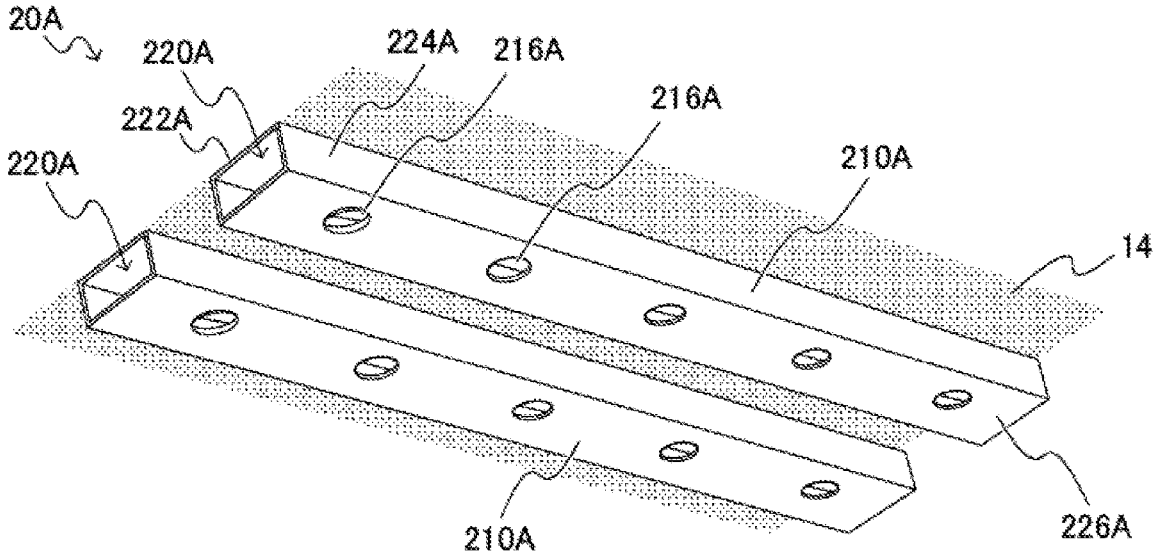
FIG. 9 is a perspective view schematically illustrating beam components of the second embodiment viewed from below.

FIG. 9 is a perspective view schematically illustrating the beam components 210A of the second embodiment viewed from below. Note that for the sake of easy understanding, in FIG. 9, the diaphragm 14 is indicated with hatching. As illustrated in FIG. 9, the beam components 210A of the second embodiment are respectively made of hollow members, in which bubble guide paths 220A are defined. In the example illustrated in FIG. 9, the beam components 210A each have a rectangular cross section, and each include an upper surface part 222A that is in contact with the lower surface of the diaphragm 14, side surface parts 224A, and a lower surface part 226A. In the lower surface parts 226A, a plurality of openings 216A are formed that allow the insides of the beam components 210A (i.e., the bubble guide paths 220A) to communicate with the outside of the beam components 210A (i.e., the anode region 18 of the plating tank 10). In the example illustrated in FIG. 9, the openings 216A each have an exact circular shape. Without any limitation to such an example, for instance, the shape may be an elliptic shape, or a polygonal shape. In the example illustrated in FIG. 9, the openings 216A are formed in the lower surface parts 226A of the beam components 210A. Instead of or in addition to them, the openings may be formed in the side surface parts 224A of the beam components 210A.

Referring again to FIGS. 7 and 8, the plating module 400A of the second embodiment includes a circulation flow path 15A that allows the bubble guide paths 220A of the beam components 210A to communicate with the outside of the plating tank 10. As illustrated in FIG. 7, in the second embodiment, the circulation flow path 15A passes through the outside of the plating tank 10, and communicates with the inside of the plating tank 10 again at a position lower than the supporting member 20A. Note that in FIG. 8, for example, the bubble guide paths 220A in the bubble guide paths 220A communicate with the single circulation flow path 15A. The circulation flow path 15A is provided with a pump 60 that sucks the plating solution Ps so as to allow the plating solution Ps to flow through the bubble guide paths 220A. The pump 60 corresponds to an example of "flow generation mechanism", and any of various known pumps may be adopted. Note that instead of or in addition to the pump 60 that sucks the plating solution Ps in the bubble guide paths 220A, the plating module 400A may include another mechanism for allowing the plating solution Ps to flow from the bubble guide paths 220 to the outside by pumping the plating solution Ps into the plating tank 10. The circulation flow path 15A is provided with a gas-liquid separator 62 for removing bubbles Bu contained in the plating solution Ps flowing through the circulation flow path 15A. Any of known mechanisms can be adopted for the gas-liquid separator 62.

By driving the pump 60, the plating solution Ps in the bubble guide paths 220A flows to the outside of the plating tank 10 (see the thick arrows in FIG. 7), passes through the gas-liquid separator 62 and is returned to the plating tank 10 (see a chain line in FIG. 7). Accordingly, the bubbles Bu that are present in the anode region 18 can be sucked into the bubble guide paths 220A through the openings 216A of the beam components 210A. The bubbles Bu having entered the bubble guide paths 220A flow with the plating solution Ps to the outside of the plating tank 10, and are separated from the plating solution Ps in the gas-liquid separator 62. Accordingly, similar to the first embodiment, the bubbles Bu that are present at the anode region 18 can be discharged to the outside of the plating tank 10 (see the thick arrows in FIG. 7). Consequently, the bubbles Bu can be prevented from being accumulated on the lower surface of the diaphragm 14, and the plating quality of the substrate Wf can be prevented from being degraded.

Modification Example

Figure 10:
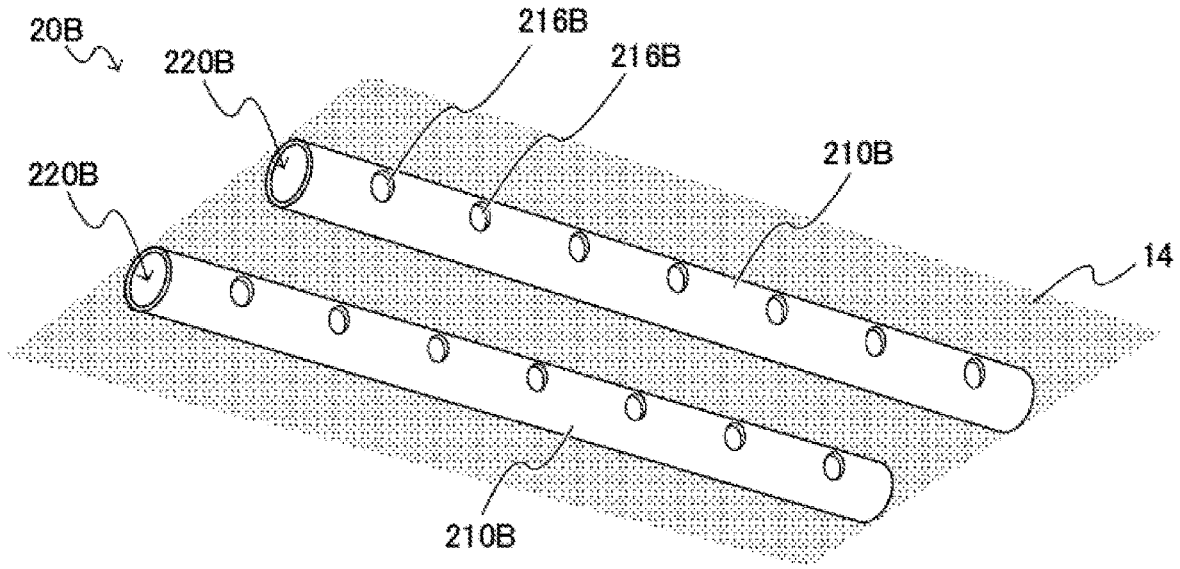
FIG. 10 is a diagram corresponding to FIG. 9 and schematically illustrating beam components of a modification example of the second embodiment.

FIG. 10 is a diagram corresponding to FIG. 9 and schematically illustrating beam components 210B of a modification example of the second embodiment. In the modification example, the beam components 210B each have a circular cross section, and is formed to be hollow, and bubble guide paths 220B are internally defined. That is, the beam components 210B have cylindrical shapes. On sides of the beam components 210B, a plurality of openings 216B are formed. Instead of or in addition to formation on the sides, the openings 216B may be formed on the undersides, or at any places. Such examples can also have functions and advantageous effects that are similar to those of the beam components 210A described above.

Also for the beam components 210A and 210B in the second embodiment, inclined surfaces may be formed as the upper surfaces of the bubble guide paths 220A and 220B. For example, the bubble guide paths 220A and 220B may have inclined surfaces that become upward in the vertical direction as approaching the pump 60. The plating module 400 of the first embodiment described above may include a pump 60 to allow the plating solution to flow to the outside through the bubble guide paths 220. In such a case, the upper surface parts 222 of the beam components 210 do not necessarily have inclined surfaces.

The present invention can be described as the following modes. [Mode 1] According to mode 1, a plating apparatus is proposed. The plating apparatus includes: a plating tank in which a plating solution is retained, and an anode is arranged: a substrate holder that is arranged above the anode, and holds a substrate serving as a cathode such that a surface to be plated of the substrate faces the anode: a diaphragm that partitions an inside of the plating tank into an anode region where the anode is arranged, and a cathode region where the substrate is arranged: and a supporting member that is in contact with a lower surface of the diaphragm and supports the diaphragm, and includes a plurality of beam components extending over regions between the anode and the substrate along the lower surface of the diaphragm, the beam components including bubble guide paths for guiding bubbles from the regions between the anode and the substrate to an outside. Mode 1 can prevent bubbles from being accumulated on the lower surface of the diaphragm.

[Mode 2] Mode 2 is the plating apparatus according to mode 1, wherein the beam components include guide grooves that are open downward, as the bubble guide paths.

[Mode 3] Mode 3 is the plating apparatus according to mode 2, wherein the guide grooves include inclined surfaces that protrude more downward as approaching a center of the plating tank. Mode 3 can suitably collect the bubbles through the guide grooves.

[Mode 4] Mode 4 is the plating apparatus according to mode 2 or 3, wherein the guide grooves are formed to have tapered shapes that become narrower as approaching respective centers of the beam components in a transverse direction.

[Mode 5] Mode 5 is the plating apparatus according to mode 1, wherein the beam components are formed to have hollow shapes where the bubble guide paths are internally defined, and have a plurality of openings allowing the bubble guide paths to communicate with the anode region.

[Mode 6] Mode 6 is the plating apparatus according to mode 5, wherein at least one or some of the openings are formed on undersides of the beam components.

[Mode 7] Mode 7 is the plating apparatus according to mode 5 or 6, wherein at least one or some of the openings are formed on sides of the beam components.

[Mode 8] Mode 8 is the plating apparatus according to any one of modes 1 to 7, further including a flow generation mechanism that sucks or pumps the plating solution such that the plating solution flows to the outside through the bubble guide paths.

[Mode 9] Mode 9 is the plating apparatus according to any one of modes 1 to 8, wherein the supporting member has an area, where the supporting member is present between a region to be plated of the substrate and the anode, of 40 percent or less of the region to be plated of the substrate, in plan view. Mode 9 can reduce the adverse effects of reduction in current between the anode and the substrate due to the supporting member.

[Mode 10] Mode 10 is the plating apparatus according to any one of modes 1 to 9, wherein the beam components each linearly extend in parallel with each other, in plan view.

[Mode 11] Mode 11 is the plating apparatus according to any one of modes 1 to 10, wherein the beam components have rectangular cross sections.

[Mode 12] Mode 12 is the plating apparatus according to any one of modes 1 to 10, wherein the beam components have cylindrical shapes.

[Mode 13] Mode 13 is the plating apparatus according to any one of modes 1 to 12, further including a rotation mechanism for rotating the substrate holder.

[Mode 14] Mode 14 is the plating apparatus according to any one of modes 1 to 13, further including a porous resistor arranged between the anode and the substrate in the plating tank, wherein the diaphragm and the supporting member are arranged below the resistor.

The embodiments and modification example of the present invention have been described above. However, the present invention is not limited to such specific embodiments and modification example. Further various modifications, changes, omissions, and additions may be applied within the scope of the invention described in the claims.

REFERENCE SIGNS LIST

10 Plating tank
11 Bottom
12 Peripheral portion
14 Diaphragm
16 Cathode region
18 Anode region
20, 20A, 20B Supporting member
210, 210A, 210B beam component
216A, 216B Opening
220, 220A, 220B Bubble guide path
30 Substrate holder
40 Rotation mechanism
50 Anode
56 Resistor
60 Pump
62 Gas-liquid separator
1000 Plating apparatus
Wf Substrate
Wfa Surface to be plated
Ps Plating solution
Bu Bubble

The invention claimed is:

1. A plating apparatus, comprising:

a plating tank in which a plating solution is retained, and an anode is arranged;

a substrate holder that is arranged above the anode, and holds a substrate serving as a cathode such that a surface to be plated of the substrate faces the anode;

a diaphragm that partitions an inside of the plating tank into an anode region where the anode is arranged, and a cathode region where the substrate is arranged, and the diaphragm being arranged to form a horizontal plane; and a supporting member that is in contact with a lower surface of the diaphragm and supports the diaphragm, and includes a plurality of beam components extending over regions between the anode and the substrate along the lower surface of the diaphragm, the beam components including bubble guide paths for guiding bubbles from the regions between the anode and the substrate to an outside, wherein the beam components of the supporting member are provided in parallel with each other.

2. The plating apparatus according to claim 1, wherein the beam components include guide grooves that are open downward, as the bubble guide paths.

3. The plating apparatus according to claim 2, wherein the guide grooves include inclined surfaces that protrude more downward as approaching a center of the plating tank.

4. The plating apparatus according to claim 2, wherein the guide grooves are formed to have tapered shapes that become narrower as approaching respective centers of the beam components in a transverse direction.

5. The plating apparatus according to claim 1, wherein the beam components are formed to have hollow shapes where the bubble guide paths are internally defined, and have a plurality of openings allowing the bubble guide paths to communicate with the anode region.

6. The plating apparatus according to claim 5, wherein at least one or some of the openings are formed on undersides of the beam components.

7. The plating apparatus according to claim 5, wherein at least one or some of the openings are formed on sides of the beam components.

8. The plating apparatus according to claim 1, further comprising a flow generation mechanism that sucks or pumps the plating solution such that the plating solution flows to the outside through the bubble guide paths.

9. The plating apparatus according to claim 1, wherein the supporting member has an area, where the supporting member is present between a region to be plated of the substrate and the anode, of 40 percent or less of the region to be plated of the substrate, in plan view.

10. The plating apparatus according to claim 1, wherein the beam components each linearly extend in parallel with each other, in plan view.

11. The plating apparatus according to claim 1, wherein the beam components have rectangular cross sections.

12. The plating apparatus according to claim 1, wherein the beam components have cylindrical shapes.

13. The plating apparatus according to claim 1, further comprising a rotation mechanism for rotating the substrate holder.

14. The plating apparatus according to claim 1, further comprising a porous resistor arranged between the anode and the substrate in the plating tank, wherein the diaphragm and the supporting member are arranged below the resistor.

* * * * *